United States Patent [19]

Edamura et al.

[11] Patent Number: 4,732,626

[45] Date of Patent: Mar. 22, 1988

[54] WATER-IN-OIL EMULSION EXPLOSIVE COMPOSITION

[75] Inventors: Koji Edamura; Akio Torii; Hiroshi Sakai, all of Chita, Japan

[73] Assignee: Nippon Oil and Fats Co., Ltd., Japan

[21] Appl. No.: 21,206

[22] Filed: Mar. 3, 1987

[30] Foreign Application Priority Data

Mar. 10, 1986 [JP] Japan ..... 61-50463

[51] Int. Cl.[4] ..... C06B 45/02

[52] U.S. Cl. ..... 149/21; 149/2; 149/36; 149/44; 149/88; 149/92; 149/105; 149/110

[58] Field of Search ..... 149/2, 21, 88, 36, 92, 149/105, 110, 44

[56] References Cited

U.S. PATENT DOCUMENTS

| | | | |
|---|---|---|---|
| 3,161,551 | 12/1964 | Egly et al. | 149/46 |
| 3,447,978 | 6/1969 | Bluhm | 149/2 |
| 3,674,578 | 7/1972 | Cattermole et al. | 149/2 |
| 3,765,964 | 10/1973 | Wade | 149/2 |
| 4,008,108 | 2/1977 | Chrisp | 149/2 |
| 4,110,134 | 8/1978 | Wade | 149/2 |
| 4,218,272 | 8/1980 | Brockington | 149/21 |
| 4,315,784 | 2/1982 | Hattori et al. | 149/2 |
| 4,315,787 | 2/1982 | Hattori et al. | 149/2 |
| 4,326,900 | 4/1982 | Hattori et al. | 149/2 |
| 4,398,976 | 8/1983 | Hattori et al. | 149/21 |
| 4,414,044 | 11/1983 | Takeuchi et al. | 149/2 |
| 4,543,136 | 9/1985 | Edamura et al. | 149/2 |
| 4,543,137 | 9/1985 | Edamura et al. | 149/2 |

FOREIGN PATENT DOCUMENTS

| | | |
|---|---|---|
| 55-158194 | 12/1980 | Japan . |
| 56-84395 | 7/1981 | Japan . |
| 60-51686 | 3/1985 | Japan . |
| 60-51685 | 3/1985 | Japan . |
| 60-90887 | 5/1985 | Japan . |

OTHER PUBLICATIONS

Kogyo Kayaku Kyokai-Shi, vol. 43, (No. 5), pp. 285–294 (1982).

Kogyo Kayaku Kyokai-Shi, vol. 45, (No. 3), pp. 149–156 (1984).

*Primary Examiner*—Stephen J. Lechert, Jr.

*Attorney, Agent, or Firm*—Parkhurst & Oliff

[57] ABSTRACT

A water-in-oil emulsion explosive having a high resistance against dead pressing is obtained by adding a cushioning medium having a high impact energy-absorbing property to a water-in-oil emulsion explosive containing a continuous phase consisting of a carbonaceous fuel, a disperse phase consisting of an aqueous solution of inorganic oxidizer salt and an emulsifier.

8 Claims, No Drawings

WATER-IN-OIL EMULSION EXPLOSIVE COMPOSITION

BACKGROUND OF THE INVENTION (a) Field of the Invention

The present invention relates to a water-in-oil emulsion explosive composition, and more particularly relates to a water-in-oil emulsion explosive composition containing a cushioning medium, which has a high absorbing property of impact energy, and having a remarkably high resistance against dead pressing.

(b) Description of Related Art

Various investigations have been recently made with respect to water-in-oil emulsion explosive (hereinafter, abbreviated as W/O explosive). As disclosed in U.S. Pat. Nos. 3,161,551, 3,447,978, 3,765,964, 3,674,578, 4,218,272, 4,110,134, 315,784, 4,315,787 and the like, the W/O explosive has a water-in-oil emulsified microfine structure consisting of a continuous phase, which consists mainly of a carbonaceous fuel component such as mineral oil, wax or the like, a disperse phase, which consists of an aqueous solution of inorganic oxidizer salt, such as ammonium nitrate or the like, an emulsifier for forming and maintaining an emulsified microfine structure, and a density adjusting agent for maintaining the detonability of the explosive. That is, the W/O explosive has an emulsified structure which is completely reverse to that of hitherto been known oil-in-water slurry explosive (hereinafter, abbreviated as O/W explosive). Due to the difference in the emulsified microfine structure, W/O explosive is different from O/W explosive in the composition and performance, and W/O explosive is superior to O/W explosive in the contact efficiency between the carbonaceous fuel component and the inorganic oxidizer salt, and hence the W/O explosive has various excellent properties. For example, the W/O explosive has a high detonation velocity, has a detonability in itself without containing a sensitizer, is good in after-detonation-fume and excellent in water-resistance, and can be adjusted widely its consistency (Kogyo Kayaku Kyokai-Shi, Vol. 43 (No. 5), pages 285–294 (1982)).

However, in order to maintain the detonability of a W/O explosive, and to ensure the cap-sensitivity and the sympathetic detonability by a booster in the W/O explosive, the use of a density adjusting agent is indispensable in order to contain bubbles in the explosive and adjust its density.

As the density adjusting agent, there have hitherto been commonly used hollow microspheres which contain an independent bubble (the above described U.S. patents, and U.S. Pat. Nos. 4,326,900, 4,398,976 and 4,414,044 and Japanese patent Laid-open application No. 158,194/80).

As the hollow microspheres, there have been used relatively rigid hollow microspheres, such as glass hollow microspheres, silica hollow microspheres, polyvinylidene chloride hollow microspheres and the like, which have a particle size of about 10–175 μm, and form predominantly a single independent bubble and have a theoretical density of not higher than 0.5 g/cm$^2$.

The hollow microspheres are used in a W/O explosive in order that a bubble contained in the hollow microspheres is acted as a hot spot in the W/O explosive, whereby the density of the W/O explosive is adjusted in order to give the detonability to the explosive.

Accordingly, it is clear from the disclosure of the working example in any of the above described U.S. patent specifications that the hollow microspheres are relatively rigid hollow microspheres, which form a single independent bubble and have a particle size of 10–175 μm.

There are common unsolved problems in water-gel explosives, such as W/O explosive, O/W explosive and the like, containing these conventional hollow miscrospheres, which form a single independent bubble, as a density adjusting agent.

That is, when it is intended to initiate a water-gel explosive, hollow microspheres contained in the explosive are broken due to the shock, gas pressure, rock pressure and the like, which have been generated by the preceding blasting of an explosive charged in an adjacent bore hole, whereby the former explosive loses its detonability, that is, the dead pressing phenomenon occurs in the former explosive.

Further, when a water-gel explosive is used in the form of a small-diameter cartridge or is blasted in a long blasting hole, the water-gel explosive is often encountered with an interruption of detonation. This phenomenon is known as a so-called channel phenomenon, wherein, when a chain of water-gel explosives charged in one bore hole are detonated, compressed gas consisting of the generated high pressure gas goes ahead of the detonation wave, and compresses a water-gel explosive, which has not yet been detonated, and as the result the compressed gas breaks hallow microspheres contained in the water-gel explosive and makes the explosive to lose its detonability (Hanazaki et al, "Kogyo Kayaku Kyokai-Shi", 45(3), 149–155 (1984)).

These two phenomena are common to each other in the point that hollow microspheres contained in a water-gel explosive are broken by the high pressure acted from the exterior, and the density of the explosive is increased and the detonability thereof is lost.

In order to improve the ability for maintaining the detonability, that is, to improve the resistance against dead pressing, hollow microspheres having a high breaking strength are generally used (Japanese Patent Laid-open Application No. 51,686/85).

However, it is necessary to use a material having a higher hardness and to make the shell thickness into a larger thickness in order to improve the strength of hollow microspheres. The use of hard hollow microspheres having a large shell thickness results in hollow microspheres having a high theoretical density. Therefore, a large amount of expensive hollow microspheres must be used in order to adjust the density of a water-gel explosive to a given density (generally 1.20 or less), which density is necessary to maintain the cap-sensitivity of the water-gel explosive. As the result, the use of a large amount of expensive hollow microspheres is not desirable in view of inexpensive production of water-gel explosive, and further causes deteriorations of explosion strength, storage stability and sympathetic detonability in the resulting water-gel explosive. While, when hollow microspheres having a very high hardness are used, although the resistance of the resulting water-gel explosive against dead pressing is somewhat improved, the external pressure, which causes dead pressing phenomenon and channel phenomenon, in the resulting water-gel explosive is higher than the breaking strength of the hollow microspheres, and therefore the resistance of water-gel explosive against dead pressing can not be satisfactorily improved by a conventional method, wherein a density adjusting agent having a higher strength is merely used.

Further, there have been known various water-gel explosives, wherein shirasu hollow microspheres, which are obtained by firing volcanic ash and the like, are used as a density adjusting agent (for example, Japanese patent Laid-open application No. 84,395/81). It is known that each particle of shirasu hollow microspheres forms a single independent bubble or forms a relatively small number of bubble assemblies, each consisting of a secondary particle containing several number of bubbles fused to each other. However, shirasu hollow microspheres are very brittle and are easily broken by a shock and pressure from the exterior, and hence the use of shirasu hollow microspheres is apt to cause the dead pressing phenomenon in the resulting water-gel explosive.

Further, there has been disclosed a method for adjusting the density of W/O explosive without using these hollow microshpheres, wherein a foaming agent or a gas-generating agent is added to the raw material mixture of the explosive or bubbles are blown into the raw material mixture by means of a mechanical stirring at the production of the explosive to contain simple bubbles in the resulting W/O explosive (for example, U.S. Pat. No. 4,008,108). However, these simple bubbles can not be contained in an amount more than a certain amount, are difficult to be contained in a W/O explosive for a long period of time, and leak from the explosive with the lapse of time, and hence the W/O explosive loses its cap-sensitivity and deteriorates in a short period of time, and is difficult to be practically used.

Japanese patent Laid-open applicaiton No. 51,685/85 and No. 90,887/85 disclose the use of a gas-retaining agent having a large particle size or a gas-retaining agent consisting of a multi-bubble body as a density adjusting agent. The use of these gas-retaining agents is a very effective means for obtaining a W/O explosive having a low detonation velocity. The inventors have found out, during the course of the investigation of these gas-retaining agents, that the use of a cushioning medium made of a specifically limited material is very effective for improving the resistance of W/O explosive against dead pressing.

It is a surprising fact that, among the recent investigations for improving the resistance of W/O explosive against dead pressing by increasing the strength of a density adjusting agent, the use of a cushioning medium made of a specifically limited material, that is, the use of a cushioning medium consisting of a soft material, is very effective for improving the resistance of W/O explosive against dead pressing.

The inventors have made various investigations with respect to this phenomenon, and arrived at the present invention.

SUMMARY OF THE INVENTION

The object of the present invention is to provide an explosive composition having excellent cap-sensitivity and/or booster-sensitivity and further having remarkably improved resistance against dead pressing.

The feature of the present invention lies in a water-in-oil emulsion explosive composition containing a continuous phase consisting of a carbonaceous fuel component, a disperse phase consisting of an aqueous solution of inorganic oxidizer salt, and an emulsifier, wherein the improvement comprises 1–45% by volume of a cushioning medium.

DESCRIPTION OF THE PREFERRED EMBODIMENT

As the carbonaceous fuel component, which constitutes the continuous phase of the water-in-oil emulsion explosive composition of the present invention (hereinafter, the term "water-in-oil emulsion explosive composition" also may be abbreviated as "W/O explosive composition" or merely "W/O explosive"), ordinarily known fuels can be used. The carbonaceous fuel components include, hydrocarbons, for example, paraffinic hydrocarbon, olefinic hydrocarbon, naphthenic hydrocarbon, aromatic hydrocarbon, other saturated or unsaturated hydrocarbon, petroleum, purified mineral oil, lubricant, liquid paraffin and the like; and hydrocarbon derivatives, such as nitrohydrocarbon and the like; waxes, for example, unpurified microcrystalline wax, purified microcrystalline wax, petrolatum, paraffin wax and the like, which are derived from fuel oil and/or petroleum; mineral waxes, such as montan wax, ozokerite and the like; animal waxes, such as whale wax and the like; and insect waxes, such as beeswax and the like. These carbonaceous fuel components are used alone or in admixture. Among them, in view of storage stability, microcrystalline wax and petrolatum are advantageously used, and petroleum wax classified into microcrystalline wax and having a melting point of not lower than 65.6° C. (150° F.) is particularly advantageously used, as a carbonaceous fuel component.

In order to adjust the consistency of the W/O emulsion explosive composition, petroleum resin, low molecular weight hydrocarbon polymers, such as low molecular weight polyethylene and low molecular weight polypropylene and the like, can be used in combination with the above described carbonaceous fuel components.

These carbonaceous fuel components are generally used in an amount of 1–10% by weight based on the total amount of the resulting W/O explosive of the present invention.

As the inorganic oxidizer salt to be used in the aqueous solution of inorganic oxidizer salt, which aqueous solution forms a disperse phase of the W/O explosive composition of the present invention, there can be used commonly known inorganic oxidizer salts, for example, nitrates of ammonia, alkali metal or alkaline earth metal, such as ammonium nitrate, sodium nitrate, calcium nitrate, sodium nitrate, calcium nitrate and the like; chlorates or perchlorates of ammonia, alkali metal or alkaline earth metal, such as sodium chlorate, ammonium perchlorate, sodium perchlorate and the like. These inorganic oxidizer slats are used alone or in the form of a mixture of at least two members.

The compounding amount of these inorganic oxidizer salts is generally 5–90% by weight, preferably 40–85% by weight, based on the total amount of the resulting explosive. The inorganic oxidizer salt is used in the form of an aqueous solution, and the compounding amount of water is generally 3–30% by weight, preferably 5–25% by weight, based on the total amount of the resulting explosive.

In general, an emulsifier is used in order to obtain an emulsified structure not only in the W/O explosive of the present invention, but also in the ordinary W/O explosive. Accordingly, any of the ordinary emulsifiers used in W/O explosive can be used in order to attain effectively the object of the present invention. The emulsifiers are, for example, fatty acid esters of sorbitan, such as sorbitan monolaurate, sorbitan monooleate, sorbitan monopalmitate, sorbitan monostearate, sorbitan sesquioleate, sorbitan dioleate, sorbitan trioleate and the like; mono- or di-glycerides of fatty acid, such as stearic acid monoglyceride and the like; fatty acid esters of polyoxyethylenesorbitan; oxazoline derivatives; imidazoline derivatives; phosphoric acid esters; alkali or alkaline earth metal salts of fatty acid; primary, secondary or tertiary amine; and the like. These emulsifiers are used alone or in admixture.

Amoung the above emulsifiers, fatty acid esters of sorbitan are preferably used, and sorbitan oleates are particularly preferably used because soritan oleates give excellent storage stability to the resulting W/O explosive.

The compounding amount of the emulsifier is 0.1–10% by weight, perferably 1–5% by weight, based on the total amount of the resulting W/O explosive.

The cushioning medium, which is used as a characteristic component of the W/O explosive composive composition of the present invention, is a chushioning medium having a structure having a high absorption capacity for impact energy, i.e., having a high cushioning effect. Any cushioning mediums having a high impact-absorbing capacity can be used substantially regardless to their material (organic or inorganic) and shape (spherical or not). However, the particle size of the cushioning medium has a influence upon the detonability of the resulting W/O explosive composition, and therefore the cushioning medium is a particulate substance having a particle size of preferably 1–3,000 μm, more preferably 5–1,000 μm, and particularly preferably 10–500 μm. Further, a cushioning medium consisting of a soft material having a high impact energy-absorbing ability, that is, having a bulk modulus of not higher than $1\times10^{11}$ dyne/cm$^2$ at room temperature, is preferably used. Such substance is generally organic substance and includes various natural and synthetic polymers. For example, when fine powders of natural rubber, synthetic rubber, sponge or the like, which has a bulk modulus of not higher than $1\times10^{8}$ dyne/cm$^2$, are mixed into a W/O explosive, the resistance of the explosive against dead pressing can be improved. However, a preferable cushioning medium is a so-called structural foam, which has in itself both the function as a gas-retaining agent having a bubble structure and the cushioning function capable of absorbing effectively impact energy. In general, among building materials sold in the market, such as sound insulator, heat insulator, weight-saving material and the like, structural foam having a discontinuous bubble structure in the interior is advantegeously used in the form of pulverization product and/or particles. As the cushioning medium having both the function as a gas-retaining agent and the cushioning function, hollow microspheres consisting of organic substance being soft at room temperature, each of which microspheres forms a single independent bubble, can be used as well. In this case, the soft organic hollow microspheres having a particle size of 5–600 μm can be preferably used as a cushioning medium. As a cushioning medium capable of giving a high resistance against dead pressing to W/O explosive, there can be advantageously used a cushioning medium consisting of a soft organic substance, and being a bubble assembly consisting of from ten to two hundred million independent bubbles, each bubble having a diameter of 5–300 μm. Among the cushioning mediums having such bubble structure, ones having bubbles, whose internal pressure is normal pressure or higher at room temperature, are particularly preferably used. This requirement is particularly important in a case where the cushioning medium consists of organic hollow microspheres, each microsphere forming a single independent bubble.

In general, these cushioning mediums are hardly broken by impact. Even the cushioning medium is broken by a force higher than its breaking strength, the broken piece does not substantially break the finely emulsified structure of the emulsion, nor substantially causes crystallization of inorganic oxidizer salt. This is probably due to the reason that the broken piece is soft and hardly has an acute angle at its corner and hardly acts as a crystallization seed.

As the cushioning mediums to be used in the present invention, there are an innumerably large number of natural and synthetic substances. Among them, there can be advantageously used, for example, pulverization products or particles of bubble-containing synthetic polymers, which have been produced by introducing bubbles by various means, such as mechanical bubbling, chemical foaming, microcapsulation and introduction of easily volatile substances, into synthetic polymers, such as homopolymers, copolymers, modified polymers and polymer blends of olefins, such as ethylene, propylene, etc., and vinyl compounds, such as vinylidene chloride, vinyl alcohol, vinyl acetate, acrylic compound, methacrylic compound, etc., polyurethane, polyester, polyamide, urea resin, epoxy resin, phenol resin and the like. Among the above described synthetic polymers, there can be particularly preferably used polystyrene, polyurethane, polyethylene, polypropylene and the like. The reason is that pre-expanded particles of these synthetic polymers can be easily and inexpensively obtained.

Cushioning mediums to be used in the present invention other than the above described cushioning mediums include cork, sponge made of synthetic rubber, natural sponge, and natural or synthetic rubber and its foam, and the like. These cushioning mediums are used alone or in admixture of at least two members.

The cushioning medium is advantageously used in combination with a conventional density adjusting agent in view of the detonability of the resulting W/O explosive composition. However, it is advantageous that a cushioning medium consisting of a structural foam is advantageously used alone in view of the improvement of the resistance against dead pressing of the resulting W/O explosive composition.

The density adjusting agent to be used together with the cushioning medium in the present invention includes any of conventional inorganic hollow microspheres obtained from glass, alumina, shale, shirasu (shirasu is a kind of volcanic ash), silica sand, volcanic rock, sodium silicate, borax, perlite, obsidian and the like; carbonaceous hollow microspheres obtained from pitch, coal, carbon and the like; and resin hollow microspheres obtained from phenolic resin, polyvinylidene chloride resin, epoxy resin, urea resin and the like. Among them, preferable density adjusting agents are glass hollow microspheres, silica hollow microspheres, shirasu hollow microspheres obtained by firing volcanic ash, polyvinylidene chloride resin hollow microspheres and phenolic resin hollow microspheres, which have an average particle size of about 10–175 μm.

In the present invention, the above described cushioning medium is used in an amount that the cushioning medium occupies 1–45% by volume in the total volume of the resulting W/O explosive composition. When the use amount of the cushioning medium is less than 1% by volume, the cushioning medium can not improve satisfactorily the resistance against dead pressing of the resulting explosive composition. When the use amount exceeds 45% by weight, the detonability of the resulting explosive composition is poor. The preferable use amount of the cushioning medium is as follows. When it is intended to use a cushioning medium so as to serve both as a cushioning medium and as a density adjusting agent, the cushioning medium is used in an amount of 3–30% by volume based on the total volume of the resulting W/O explosive composition. When the cushioning medium is used in combination with a conventional density adjusting agent, the cushioning agent is used in a variant amount depending upon the use amount of the density adjusting agent, and in general is preferably used in an amount of 5–20% by volume based on the total volume of the resulting W/O explosive composition. In this case, the conventional density adjusting agent is used in amount of generally 0.05–40% by weight, preferably 0.1–15% by weight, and more preferably 0.2–10% by weight, based on the total amount of the resulting W/O explosive composition.

When the cushioning medium is used alone without using a conventional density adjusting agent, the resulting W/O explosive composition has generally low detonation velocity. Therefore, it is advantageous, in view of detonation velocity and low temperature detonability, to use a cushioning medium in combination with a conventional density adjusting agent in the production of W/O explosive compositions other than coal mine explosive, smooth-blasting explosive, presplitting explosive and the like, which are demanded to have particularly low detonation velocity.

When a cushioning medium is used in combination with a conventional density adjusting agent, it is necessary that the cushioning medium occupies 2–80% by volume, preferably 5–40% by volume, in the total volume of the cushioning medium and the density adjusting agent. When the amount of the cushioning medium is less than 2% volume based on the total volume of the cushioning medium and the density adjusting agent, the cushioning medium can not satisfactorily improve the resistance against dead pressing of the resulting W/O explosive composition, and further the resulting W/O explosive composition is poor in the detonability.

In the present invention, the use of sensitizer is not always necessary. However, when the cushioning medium according to the present invention is used in combination with a sensitizer, the amount of a density adjusting agent to be used can be greatly decreased, and both the resistance against dead pressing and the detonability of the resulting W/O explosive composition can be improved.

The sensitizers to be used in the present invention are commonly known sensitizers, for example, monomethylamine nitrate, hydrazine nitrate, ethylenediamine dinitrate, ethanolamine nitrate, glycinonitrile nitrate, guanidine nitrate, urea nitrate, trinitrotoluene, dinitrotoluene, aluminum powder and the like.

These sensitizers can be used alone or in the admixture of at least two members. The compounding amount of the sensitizer is 0–80% by weight, preferably 0.5–50% by weight, more preferably 1–40% by weight, based on the total amount of the resulting W/O explosive composition. A W/O explosive composition containing more than 80% by weight of the sensitizer is dangerous in the production, and further is not economic. Among the above described sensitizers, monomethylamine nitrate, hydrazine nitrate, ethylenediamine dinitrate and ethanolamine nitrate are preferably used, and hydrazine nitrate is particularly preferably used. Because, these compounds have a high effect for promoting the dissolving of inorganic oxidizer salt in water, and are low in the sensitivity and stable in the handling during the production of the W/O explosive composition.

The W/O explosive composition of the present invention, which has the above described composition, can be produced, for example, in the following manner.

Ammonium nitrate or a mixture of ammonium nitrate and other inorganic oxidizer salt is dissolved in water about 60°–100° C. occasionally together with a sensitizer to produce an aqueous solution of inorganic oxide salt. Separately, a carbonaceous fuel and an emulsifier are mixed with each other and melted at a temperature (generally 70°–90° C.), at which the resulting mixture is formed into liquid, to produce a combustible material mixture.

Then, the above obtained aqueous solution of inorganic oxidizer salt is mixed with the combustible material mixture at a temperature of 60°–90° C. under agitation at a rate of 600–6,000 rpm to obtain a W/O emulsion.

The resulting W/O emulsion is mixed with a cushioning medium of the present invention and occasionally a density adjusting agent in a vertical kneader while agitating the mass at a rate of about 30 rpm, obtain a W/O explosive composition. In the above described procedure, the sensitizer or a part of the inorganic oxidizer salt is not dissolved in water but may be directly added to the emulsion and kneaded together with the emulsion, whereby a W/O explosive composition may be produced.

The W/O explosive composition of the present invention, which contains the cushioning medium, is remarkably superior to a conventional W/O explosive composition not containing the cushioning medium in the resistance against dead pressing caused by the impact from the exterior. Particularly, when the cushioning medium has a structure, which acts both as a cushioning medium and a density adjusting agent, the resulting W/O explosive composition has a cap-sensitivity in itself without the use of a conventional density adjusting agents, and further has a remarkably excellent resistance against dead pressing. In this case, the breakage of finely emulsified structure due to the addition of a density adjusting agent during the production of the W/O explosive composition does not occur, and hence the resulting W/O explosive composition is small in the deterioration of the performance due to the storage for a long period of time, and has an excellent storage stability.

The present invention will be explained in detail hereinafter referring to the following Examples and Comparative examples. However, the present invention is not limited to the examples. In the examples, "parts" means "parts by weight".

EXAMPLE 1

A W/O explosive having a composition shown in Table 1 was produced in the following manner.

To 12.2 parts of water were added 75.5 parts of ammonium nitrate, 5.0 parts of sodium nitrate, and the resulting mixture was heated to 90° C. to dissolve completely the nitrates in the water and to obtain an aqueous solution of inorganic oxidizer salt. A mixture of 0.4 part of No. 2 gas oil as a carbonaceous fuel, 3.0 parts of microcrystalline wax and 1.7 parts of sorbitan oleate was melted at 90° C. To the melted mixture was gradually added 92.7 parts of the above described aqueous solution of inorganic oxidizer salt while agitating and emulsifying the resulting mixture at a rate of 650 rpm under heating at 90° C. After completion of the addition, the agitation was further continued at a rate of 1,800 rpm for 3 minutes to obtain 97.8 parts of a W/O emulsion. Then, 2.0 parts of glass hollow microspheres (trademark: Glass microballoon (B-15)/250, sold by Minnesota Mining Manufacturing Co.) as a density adjusting agent, 0.2 part of foams of vinylidene chloride-acrylonitrile-acrylic acid ester copolymer (trademark: Microperl F-30, sold by Matsumoto Yushi Seiyaku Co.) and 97.8 parts of the above obtained W/O emulsion were mixed and kneaded at 60°-80° C. to obtain a W/O explosive composition. The resulting W/O explosive composition was weighted 100 g by 100 g, and each mass was shaped into a cylindrical mass having a diameter of 25 mm, and then wrapped with a laminated paper to obtain a W/O explosive cartridge.

The resistance of the resulting W/O explosive composition against dead pressing was evaluated according to the following method by the use of above obtained cartridge.

That is, a donor cartridge and an acceptor cartridge, which was the above obtained cartridge of explosive to be tested, each of the donor cartridge and the acceptor cartridge having been provided in its interior with a No. 6 instantaneous electric blasting cap packed in a steel tube, were hung at the center portion of a pond having a depth of water of 2.5 m such that they were located apart from each other by a certain and predetermined distance (D) and further located at a depth of water of 1 m from the surface of the water. After 10 seconds of the blasting of the donor cartridge, the acceptor cartridge, which was the explosive to be tested, was detonated by means of a delay blasting machine. Vibration generated by the detonation of the acceptor cartridge was caught by means of a moving coil-type vibroscope arranged on the border of the pond, which border was located by 15 m distant from the center of the pond, and the wave form of the vibration was recorded by means of an electromagnetic oscillograph, and the amount of explosion energy generated in the acceptor cartridge was measured. In the judgment of the complete detonation of the acceptor cartridge, the amount of explosion energy generated in the acceptor cartridge in the case where a donor cartridge had been blasted, was compared with the amount of explosion energy generated in the acceptor cartridge in the case where a donor cartridge had not been blasted, and whether or not the acceptor cartridge was completely detonated was estimated by calculating the complete detonation percentage by the following formula:

$$E = \left(\frac{A_1}{A_0}\right)^{1.35} \times 100(\%)$$

In the above formula, $A_1$ is the amplitude of the rising wave form of the vibration wave of the acceptor cartridge in the case where a donor cartridge has been blasted, and $A_0$ is the amplitude of the rising wave of the vibration wave of the acceptor cartridge in the case where a donor cartridge has not been blasted.

When E is 80% or more, the acceptor cartridge was estimated to be completely detonated, and the distance D between the donor cartridge and the acceptor cartridge in the case where the acceptor cartridge was completely detonated successively 3 times was indicated in Table 1 as the complete detonation distance in dead pressing test in water.

As the donor cartridge, there was used a donor cartridge produced by charging 40 g of No. 2 Enoki dynamite (one kind of ammonium gelatin-dynamite) in a vinyl chloride pipe having an inner diameter of 22 mm, a length of 75 mm and a wall thickness of 2 mm in a density of 1.40 g/cm$^3$.

The impact peak pressures, to which the acceptor cartridge was exposed in water at a distance of D=1 m and 0.5 m apart from the donor cartridge were about 150 kg/cm$^2$ and about 400 kg/cm$^2$, respectively.

When the distance D is 0.4 mm or less, the blasting cap is not detonated sometimes, and the explosion to be tested was not estimated with respect to the resistance against dead pressing at a distance D of 0.4 m or less.

EXAMPLES 2-10

W/O explosives having a composition of Examples 2-10 shown in Table 1 were produced according to Example 1.

Each of the resulting E/O explosives was subjected to the same resistance test against dead pressing as described in Example 1. The density of the explosive to be tested was measured as well.

The obtained results are shown in Table 1.

COMPARATIVE EXAMPLES 1-5

W/O explosives having a composition of Comparative examples 1-5 shown in Table 1 were produced according to Example 1.

Each of the resulting W/O explosives was subjected to the same resistance test against dead pressing as described in Example 1. The density of the W/O explosives was also measured as well. The obtained results are shown in Table 1.

All the Comparative examples illustrate W/O explosive compositions containing no cushioning medium. Comparative example 1 corresponds to Example 1, Comparative example 2 corresponds to Example 2, and Comparative example 3 corresponds to Example 4. Comparative example 4 uses a density adjusting agent made of the same material as used in Comparative example 1, but the density adjusting agent is glass hollow microspheres having a large shell thickness and a high breaking strength. Comparative example 5 corresponds to Example 10.

The density adjusting agents described in Table 1 are as follows.

(1) GMB ((B-15)/250): glass hollow microspheres (sold by Minesota Mining Manufacturing Co., Ltd., Glass Microballoon (B-15)/250)

(2) GMB ((B-28)/750): glass hollow microspheres (sold by Minesota Mining Manufacturing Co., Ltd., Glass Microballoon (B-28)/750)

(3) GMB (Q cell #500): glass hollow microspheres (sold by THE PQ Corporation, Glass Microballoon Q cell #500)

(4) SMB (SPW-7): shirasu hollow microspheres (sold by Kushiro Sekitan Kanryu Co., Ltd. Shirasu Microballoon SPW-7)

(5) SMB (Sankilite YO2): shirasu hollow microspheres (sold by Sanki Kogyo Co., Ltd., Sankilite YO2)

(6) RMB (Expancel DE): polyvinylidene chloride resin spheres (sold by KemaNord Plastics Corp., Expancel DE)

The cushioning medium described in Table 1 are as follows.

(1) Pre-expanded polystyrene beads A: beads obtained by pre-expanding Bead IBE, which is expandable polystyrene sold by Mitsubishi Yuka Badische Co., Ltd. into 30 times its original volume (bulk density: 0.020, average particle size: 1.0 mm)

(2) Pre-expanded polystyrene beads B: beads obtained by pre-expanding beads having a particle size of less than 0.2 mm among beads of expandable polystyrene sold by Mitsubishi Yuka Badische Co., Ltd. (bulk density: 0.023, average particle size: 0.6 mm)

(3) Pre-expanded propylene beads: beads obtained by pre-expanding expandable polypropylene sold by Mitsubishi Petrochemical Co. Ltd. (bulk density: 0.021)

(4) Expanded polyethylene chips: chips having a size of 0.1–5 mm, which are obtained by chipping expanded polyethylene board sold by Asahi-Dow Chemical Co., Ltd. by means of a wire brush (bulk density: 0.012)

(5) Microperl F-30 foams: foams obtained by expanding Microperl F-30 sold by Matsumoto Yushi Seiyaku Co., Ltd. in an aqueous solution of ammonium nitrate (6) Cork powders: Cork powders obtained by passing commercially available cork powders through the 14 mesh sieve (7) Cut pieces of expanded polyvinyl chloride sheet: cut pieces obtained by cutting a commercially available expanded polyvinyl chloride sheet into a size of 3 mm or less.

(8) Sponge chips: sponge chips obtained by cutting a commercially available sponge used for washing tableware in the kitchen into a size of 3 mm or less (9) Rubber beads: rubber cubes having an edge length of 1 mm or less, which has been obtained by cutting a rubber band.

TABLE 1(a)

| | | Example | | | | | | | | | | Comparative example | | | | |
|---|---|---|---|---|---|---|---|---|---|---|---|---|---|---|---|---|
| | Composition | 1 | 2 | 3 | 4 | 5 | 6 | 7 | 8 | 9 | 10 | 1 | 2 | 3 | 4 | 5 |
| Aqueous solution of inorganic oxidizer salt | Ammonium nitrate | 75.5 | 75.2 | 72.0 | 72.6 | 73.5 | 75.0 | 69.0 | 69.0 | | | 75.5 | 75.2 | 72.6 | 73.8 | |
| | Sodium nitrate | 5.0 | | 3.3 | 2.1 | 5.6 | 5.2 | 10.2 | 10.2 | 9.9 | 9.9 | 5.0 | | 2.1 | 4.4 | 9.9 |
| | Calcium nitrate | | | | 1.2 | | | | | 3.7 | 3.7 | | | 1.2 | | 3.7 |
| | Sodium chlorate | | 4.4 | 4.5 | 2.1 | | | | | | | | 4.4 | 2.1 | | |
| | Sodium perchlorate | | | | 2.4 | | | | | | | | | 2.4 | | |
| | Water | 12.2 | 10.3 | 11.6 | 11.6 | 11.2 | 9.5 | 9.1 | 9.1 | 3.0 | 3.0 | 12.2 | 10.3 | 11.6 | 10.7 | 3.0 |
| Sensitizer | Hydrazine nitrate | | | | | 4.0 | 2.0 | 3.0 | 3.0 | 70.0 | 66.0 | | | | | 66.0 |
| | Monomethylamine nitrate | | | | | | 1.3 | | | | | | | | | |
| | Ethylenediamine dinitrate | | | | | | | | | 5.0 | 5.0 | | | | | 5.0 |
| | Ethanolamine nitrate | | | | | | | | | 5.0 | 5.0 | | | | | 5.0 |
| | Aluminum | | | | | | | 1.0 | 1.0 | | | | | | | |

TABLE 1(b)

| | | Example | | | | | | | | | | Comparative example | | | | |
|---|---|---|---|---|---|---|---|---|---|---|---|---|---|---|---|---|
| | Composition | 1 | 2 | 3 | 4 | 5 | 6 | 7 | 8 | 9 | 10 | 1 | 2 | 3 | 4 | 5 |
| Emulsifier | Solbitan oleate | 1.7 | 1.8 | 1.8 | 1.0 | 1.6 | 1.2 | 1.6 | 1.6 | 1.5 | 1.5 | 1.7 | 1.8 | 1.0 | 1.7 | 1.5 |
| | Stearic acid monoglyceride | | | | 0.8 | | 0.5 | | | | | | | 0.8 | | |
| Carbonaceous fuel component | No. 2 gas oil | 0.4 | | | | | | | | | | 0.4 | | | | |
| | Microchrystalline wax | 3.0 | 3.6 | 2.6 | 3.6 | 3.2 | 3.4 | 3.2 | 3.2 | 1.5 | 1.5 | 3.0 | 3.6 | 3.6 | 3.4 | 1.5 |
| | Paraffin wax | | | 1.0 | | | | | | | | | | | | |
| Density adjusting agent | (1) GMB ((B-15)/250) | 2.0 | | | | | | | | | 2.0 | 2.2 | | | | 2.0 |
| | (2) ((B-28/750) | | | | | | 1.0 | | 2.2 | | | | | | 6.0 | |
| | (3) (Qcell #500) | | | 2.9 | | | | | | | | | | | | |
| | (4) SMB (SPW-7) | | 3.0 | | | | | | | | | | 4.7 | | | |
| | (5) (Sankilite Y02) | | | | | | | 2.0 | | | | | | | | 2.4 |
| | (6) RMB (Expancel DE) | | | | 0.3 | | | | | | | | | 0.6 | | |

TABLE 1(c)

| | | Example | | | | | | | | | | Comparative example | | | | |
|---|---|---|---|---|---|---|---|---|---|---|---|---|---|---|---|---|
| | Composition | 1 | 2 | 3 | 4 | 5 | 6 | 7 | 8 | 9 | 10 | 1 | 2 | 3 | 4 | 5 |
| Cushioning medium | (1) Pre-expanded polystyrene beads A | | | | | | 0.6 | | | | | | | | | |
| | (2) Pre-expanded polystyrene beads B | | | 0.3 | 0.3 | 0.9 | | 0.7 | | | | | | | | |
| | (3) Pre-expanded polypropylene beads | | | | | | | | | 0.2 | | | | | | |
| | (4) Expanded polyethylene chips | | 0.7 | | | | | | | 0.2 | | | | | | |
| | (5) Microperl F-30 foams | 0.2 | | | | | | | 0.7 | | | | | | | |
| | (6) Cork powders | | 1.0 | | | | | | | | | | | | | |
| | (7) Cut pieces of expanded polyvinyl | | | | | | | 0.2 | | | | | | | | |

TABLE 1(c)-continued

| Composition | Example 1 | 2 | 3 | 4 | 5 | 6 | 7 | 8 | 9 | 10 | Comparative example 1 | 2 | 3 | 4 | 5 |
|---|---|---|---|---|---|---|---|---|---|---|---|---|---|---|---|
| chloride sheet | | | | | | | | | | | | | | | |
| (8) Sponge chips | | | | | | 0.1 | | | | | | | | | |
| (9) Rubber beads | | | | | | 0.2 | | | | 2.4 | | | | | |
| Density (g/cc) | 1.07 | 1.10 | 1.11 | 1.12 | 1.04 | 1.16 | 1.10 | 1.12 | 1.12 | 1.20 | 1.16 | 1.10 | 1.12 | 1.14 | 1.15 |
| Complete detonation distance in a dead pressing test in water (m) | 0.8 | 0.5 | 0.5 | 0.5 | 0.4 | 0.5 | 0.5 | 0.6 | 0.4 | 0.4 | 2.1 | 0.9 | 0.9 | 0.7 | 0.8 |

What is claimed is:

1. A water-in-oil emulsion explosive composition containing a continuous phase consisting of a carbonaceous fuel component, a dispersed phase consisting of an aqueous solution of inorganic oxidizer salt, an emulsifier, and a density adjusting agent, wherein the improvement comprises:

1–45% by volume of a cushioning medium consisting of an organic substance having a bulk modulus of not higher than $1\times10^{11}$ dyne/cm$^2$, said cushioning medium occupying not less than 2% by volume but less than 30% by volume in the total volume of the density adjusting agent and the cushioning medium.

2. A water-in-oil emulsion explosive composition according to claim 1, wherein the cushioning medium consists of pulverization product and/or particles of a structural foam having a bubble structure in itself and having a particle size of 1–3,000 μm.

3. A water-in-oil emulsion explosive composition according to claim 2, wherein the pulverization product and/or particles of the structural foam contain a bubble having an internal pressure, which is the normal pressure or higher at room temperature.

4. A water-in-oil emulsion explosive composition according to claim 2, wherein the particle of the structural foam is a bubble assembly consisting of from ten to two hundred million independent bubbles agglomerated to each other, each bubble having a diameter of 5–300 μm.

5. A water-in-oil emulsion explosive composition according to claim 2, wherein the structural foam consists of polystyrene, polyurethane, polyethylene or polypropylene.

6. A water-in-oil emulsion explosive composition according to claim 5, wherein the explosive composition contains at least one sensitizer selected form the group consisting of monomethylamine nitrate, hydrazine nitrate, ethylenediamine dinitrate, ethanolamine nitrate, glycinonitril nitrate, guanidine nitrate, urea nitrate, trinitrotoluene, dinitrotoluene and aluminum powder.

7. A water-in-oil emulsion explosive composition according to claim 1, which comprises 1–10% by weight of a carbonaceous fuel component, 5–90% by weight of an aqueous solution of inorganic oxidizer salt, 3–30% by weight of water and 0.1–10% by weight of an emulsifier, and further comprises 1–45% by volume of a cushioning medium.

8. A water-in-oil emulsion explosive composition according to claim 1, which comprises 1–10% by weight a carbonaceous fuel component, 40–85% by weight of an aqueous solution of inorganic oxidizer salt, 5–25% by weight of water, 1–5% by weight of an emulsifier, 0.5–50% by weight of a sensitizer and 0.1–15% by weight of a density adjusting agent, and further comprises 5–20% by volume of a cushioning medium.

* * * * *